US005692885A

United States Patent [19]

Langer

[11] Patent Number: 5,692,885

[45] Date of Patent: Dec. 2, 1997

[54] LABORATORY PUMP FOR LIQUIDS

[75] Inventor: Alfred Langer, Bornheim, Germany

[73] Assignee: Janke & Kunkel GmbH & Co. KG IKA-Labortechnik, Staufen, Germany

[21] Appl. No.: 490,220

[22] Filed: Jun. 14, 1995

[30] Foreign Application Priority Data

Jun. 18, 1994 [DE] Germany ..... 44 21 431.6

[51] Int. Cl.[6] ..... F04C 15/00; F04D 13/02

[52] U.S. Cl. ..... 417/420; 417/32

[58] Field of Search ..... 417/420, 32

[56] References Cited

U.S. PATENT DOCUMENTS

| | | | |
|---|---|---|---|
| 3,139,832 | 7/1964 | Saunders . | |
| 3,485,177 | 12/1969 | Clay . | |
| 3,493,036 | 2/1970 | Good et al. . | |
| 3,771,906 | 11/1973 | Bourke . | |
| 3,986,797 | 10/1976 | Kopf | 417/420 |
| 4,266,914 | 5/1981 | Dickinson . | |
| 4,643,641 | 2/1987 | Clausen et al. . | |
| 4,747,744 | 5/1988 | Dominique et al. . | |
| 4,846,641 | 7/1989 | Pieters . | |
| 4,927,337 | 5/1990 | Lustwerk . | |
| 5,431,340 | 7/1995 | Schirpke | 417/420 X |
| 5,484,265 | 1/1996 | Horvath et al. | 417/420 X |
| 5,525,039 | 6/1996 | Sieghartner | 417/32 |

FOREIGN PATENT DOCUMENTS

| | | |
|---|---|---|
| 0 334 646 A1 | 9/1989 | European Pat. Off. . |
| A 1 540 100 | 9/1968 | France . |
| C 753 585 | 5/1953 | Germany . |
| 213024 | 8/1984 | Germany . |
| 43 05 023 A1 | 8/1993 | Germany . |
| 9400471 | 6/1994 | Germany . |
| 668919 | 2/1989 | Switzerland . |
| 2 047 810 | 12/1980 | United Kingdom . |
| WO A 81 01727 | 6/1981 | WIPO . |

*Primary Examiner*—Richard E. Gluck
*Attorney, Agent, or Firm*—Panitch Schwarze Jacobs & Nadel, P.C.

[57] ABSTRACT

A laboratory pump (1) for liquids has a pump housing (2) with an inlet opening (3) and an outlet opening (4) and in which at least one pump rotor (5) rotates. The pump rotor (5) is joined either directly or indirectly by means of a transmission with a magnet (6), which is magnetically coupled with a rotating magnetic field of a magnetic stirrer (8). In addition, the pump housing (2) of the pump (1) can be joined with the magnetic stirrer (8) in such a way that the magnet (6) comes under the influence range of the rotating magnetic field of the magnetic stirrer (8) and is driven by it. The pump has no driving means of its own, and therefore can be designed in an especially simple way. Magnetic stirrers (8) present in laboratories can be used for driving the pump (1), and thus obtain an additional function.

17 Claims, 6 Drawing Sheets

LABORATORY PUMP FOR LIQUIDS

FIELD OF THE INVENTION

The invention pertains to a laboratory pump for liquids, with at least one pump housing having an inlet opening and an outlet opening, at least one pump rotor rotating therein, and a drive for the pump rotor, wherein the pump rotor is connected with a magnet, either directly or indirectly by means of a transmission, or is itself configured as a magnet.

BACKGROUND OF THE INVENTION

Laboratory pumps have been known for a long time, and are used in large numbers in order, for example, to deliver or to circulate liquids in experimental setups. These previously known pumps can be used to particularly good advantage for feeding or circulating bath liquids of thermostatically controlled and generally double-walled containers. In these containers there is the problem that the liquid inside the double walls gradually loses heat, so that the medium found in this container would not be able to maintain its temperature if the bath liquid were not constantly being reheated. For that purpose, it is circulated and is reheated outside of the container, in conjunction with which the circulation is controlled by temperature sensors and/or thermostats.

What is disadvantageous about this, however, is that the previously known pumps have their own drive motors and, as a result, require a design that is comparatively difficult to use and expensive for a laboratory operation. In addition, an electric motor connected to the electric power supply system is usually provided as the drive motor, so that appropriate safety measures are necessary to prevent impermissibly high contact voltages, such as wiring a transformer ahead in the circuit or encapsulating the electric motor, especially with respect to the pumping area.

A device for stirring or pumping a medium is already known from CH-668 919 A5. This device has a free-turning magnetic rotor which, when turning, can exert a stirring or pumping effect. A feeder device supplies a phase-shifted alternating current and energizes an electromagnetic drive apparatus which has a ring-shaped core made of ferromagnetic material that is wound with at least two fixed field winding segments in the manner of a toroidal core, as a result of which the electromagnetic drive apparatus creates a rotating magnetic field that sets the rotor into rotating motion. This involves a highly specialized device with which a corresponding electromagnetic drive apparatus with a ring-shaped core is necessary. Only this drive apparatus can be used as an option in order to create either a pump or a stirring device. However, the holder for a container filled with a liquid or the like to be stirred must additionally be attached, if the apparatus is to be used as a stirring device. In this regard, a special holding means is necessary, which must be opened each time, in order to be able to use the drive apparatus for various installations. In order for the apparatus to be able to work as a pump, a tube must be inserted in the ring formed by the drive apparatus to guide the medium to be pumped in a specific direction. A specially shaped magnetic rotor in the interior of this tube provides the necessary pumping action.

Thus, this apparatus is suitable for use either for stirring or for pumping only after appropriate conversion, and when used for stirring, it requires additional holding devices for the stirring container.

SUMMARY OF THE INVENTION

An object of the invention is therefore to create a laboratory pump of the type mentioned at the beginning, in which the advantage of not requiring its own drive motor is retained, but which can be used in laboratories simply and without large installations or conversion work.

The achievement of this object resides in a magnetic stirrer being provided as the driving means for the pump rotor, and the pump being connected by means of its pump housing to the magnetic stirrer having a placement surface, at least in the planar extent of a magnetic stirrer placement plate, in such a way that the driving magnetic field of the magnetic stirrer is magnetically coupled with the magnet of the pump.

Thus, in an advantageous way, it is not just the drive aggregate of a stirrer functioning by means of a magnetic bar that is provided as the driving means of the laboratory pump, but rather a complete magnetic stirrer that is available in large numbers in most laboratories. Therefore, the pump not only does not require its own drive motor, and as a result can be built in a correspondingly simple and cost-effective way, but it can also be combined in a simple way with the available magnetic stirrer on the stirrer's placement surface, in order to be functional in that simple a way. The pump only needs to be placed on the placement surface of the magnetic stirrer and joined to it in order to be brought into a driving connection. If it is again removed, the magnetic stirrer is immediately available in its original form as a stirring device. Thus, it is not just the magnetic drive apparatus of a magnetic stirrer that is used as the driving means for the pump, rather it is the magnetic stirrer itself.

In addition, the pump housing can be designed in an especially simple way, since the shaft of the pump rotor does not have to be brought to the outside as a drive shaft and sealed with respect to the pump housing. By means of the pump in accordance with the invention the magnetic stirrers present in laboratories are provided with an additional function, so that better use can be made of these comparatively expensive devices.

In an advantageous way, it is provided that the pump rotor is configured as a vane pump impeller. The liquid can then be drawn in axially at the top of the pump impeller and conveyed out radially. In conjunction with this, it is beneficial if the pump impeller has symmetrically configured conveying vanes so that the pump, when being used for example with magnetic stirrers that have a reversible direction of rotation, can be driven equally in differing directions of rotation.

It is especially advantageous if the pump is heatable, specifically, if it has heatable housing walls. The pump is especially well-suited for the circulation of bath liquids from thermostatically regulated containers. In this regard, the bath liquid can not only be circulated by the pump, but it can also be brought to the desired temperature by means of the heater, which can for example be integrated into the pump, so that in sum, an easy-to-handle apparatus is provided, thus eliminating the need for connection with an external heater.

A further development of the invention provides that the magnetic has exhibits a heating plate, and that a thermally conductive area is provided on the contact surface between the magnetic stirrer and the pump housing. With a pump of this type, in an advantageous way, it is not only the driving means of the magnetic stirrer that can be used for the delivery and temperature regulation of liquids, but also its heating plate as well. Since the wall area of the pump housing that touches the heating plate is heated, the pump itself does not require any heating of its own and can therefore be configured in a correspondingly simple way.

It is expedient if, for the regulation of the liquid temperature of a liquid bath being circulated by means of the pump, a thermostat or temperature sensor is provided that is coupled with the stirrer drive of the magnetic stirrer and/or the heater. The pump is thereby especially well-suited for use as a circulating pump for the bath liquid of temperature-regulated, double-walled containers, wherein the temperature sensor can be provided at the container. The pump and/or the heater is then switched on only when the container temperature detected by the temperature sensor goes below a predetermined value.

It is advantageous if the pump is joined by means of its pump housing in a positive-fit manner with the placement plate of the magnetic stirrer, and for this purpose projections and/or a coupling edge that encircles at least some regions is provided on the pump housing. By these means the pump housing can be mounted on the magnetic stirrer, specifically on its placement or heating plate. It is indeed sufficient if the pump housing is simply placed upon the placement surface of the magnetic stirrer. However, a positive-fit connection at the periphery of the placement plate is preferable so that the pump cannot easily slip sideways on the placement plate when, for example, the incoming or outgoing liquid feed lines attached to the pump are being routed.

In addition, the pump can also have holding clamps, holding springs, or similar means of attachment for fixing it to the magnetic stirrer, in particular on its placement or heating plate. Any turning of the pump housing, especially when the stirring drive of the magnetic stirrer is switched on, is thereby avoided.

One embodiment of the present invention provides that the pump rotor has at least two pumping vanes arranged on either side of its rotation axis on one of its diameters, and that the magnet is arranged perpendicular to this diameter. The magnet and the two pumping vanes of the pump rotor are thus arranged cross-wise to each other so that, in practical terms, a total of four pumping vanes results, two being formed by the actual pump rotor, and the remaining two being formed by the magnet itself.

It is advantageous if the pump rotor has at least two pumping vanes, one arranged on each side of its rotation axis on one of its diameters, and if the magnet is molded or inserted into these pumping vanes. The magnet is thus integrated into the pumping vanes of the pump rotor, so that overall, a pump rotor with an especially compact design is provided. It is then expedient if the pumping vanes are made of plastic in which the magnet is completely embedded so that the latter is protected against corrosion. The pump can then be used for the delivery of chemically aggressive media as well.

In an advantageous way, it is provided that the pump rotor has several pumping vanes arranged symmetrically to its rotation axis, and joined to a stabilizing ring or arranged on a common carrier disk. The pumping vanes can then be configured as thin-walled lamina that are preferably arranged radially to the rotation axis of the pump rotor and joined into one stable unit by the stabilizing ring or the carrier disk. In conjunction with this, the stabilizing ring, the carrier disk, and/or a pumping vane can at the same time be configured as a holding means for the magnet.

It is especially beneficial if the magnet is arranged closely adjacent to the housing wall of the pump housing that is adjacent to the placement surface of the magnetic stirrer. As a result, there is provided an especially good coupling of the magnet to the magnetic field of the magnetic stirrer which drives the magnet, so that a correspondingly high driving torque can be transmitted to the pump rotor.

A further development of the invention provides two pump rotors that work with one another or engage with one another, one of which is directly or indirectly joined to the magnet or is configured as a magnet, and when in its operating position is coupled with the driving magnetic field of the magnetic stirrer. Such a pump can, for example, be configured as a Roots pump with two contra-rotating rotary piston pump rotors, which are in forced synchronization by means of two like-size gearwheels that engage with each other. A positive displacement pump of this type has improved suction power when compared to a centrifugal pump, and makes possible—with appropriate design of the magnetic coupling to the magnetic stirrer—higher delivery pressures.

It is advantageous if the two pump rotors that engage with each other are the gearwheels of a gear pump. The pump then requires only a very low overall height, so that the pump housing can practically be configured as a flat disk. In conjunction with this, the inlet and outlet openings can be provided laterally on the pump housing so that the upper housing wall of the pump when it is in its operating position can be used as an additional placement surface, for example, for setting a beaker on.

Advantageously, it is provided that one gearwheel has additional toothing for action upon or engagement with a pinion gear joined with the magnet or configured itself as a magnet. As a result, the rotation speed of the drive, which is determined by the magnetic stirrer, can be translated to a lower pump rotor speed so that a higher delivery pressure can be attained with the pump.

It is especially beneficial if the additional toothing is an inner toothing. In this way, no additional housing structural space is needed for the pinion gear that engages with the inner toothing, so that the pump housing can be designed in an especially flat and compact way.

BRIEF DESCRIPTION OF THE DRAWINGS

The foregoing summary, as well as the following detailed description of preferred embodiments of the invention, will be better understood when read in conjunction with the appended drawings which show further features and advantages of the invention. For the purpose of illustrating the invention, there are shown in the drawings embodiments which are presently preferred. It should be understood, however, that the invention is not limited to the precise arrangements and instrumentalities shown. In the drawings, shown in various scales and in part highly schematicized, are the following:

FIG. 2 shows a bottom view of the laboratory pump shown in FIG. 1 in which, to make clearer the design of the pump, the pump rotor found in the interior of the pump housing is also drawn in;

DETAILED DESCRIPTION OF PREFERRED EMBODIMENTS

Figure 1:
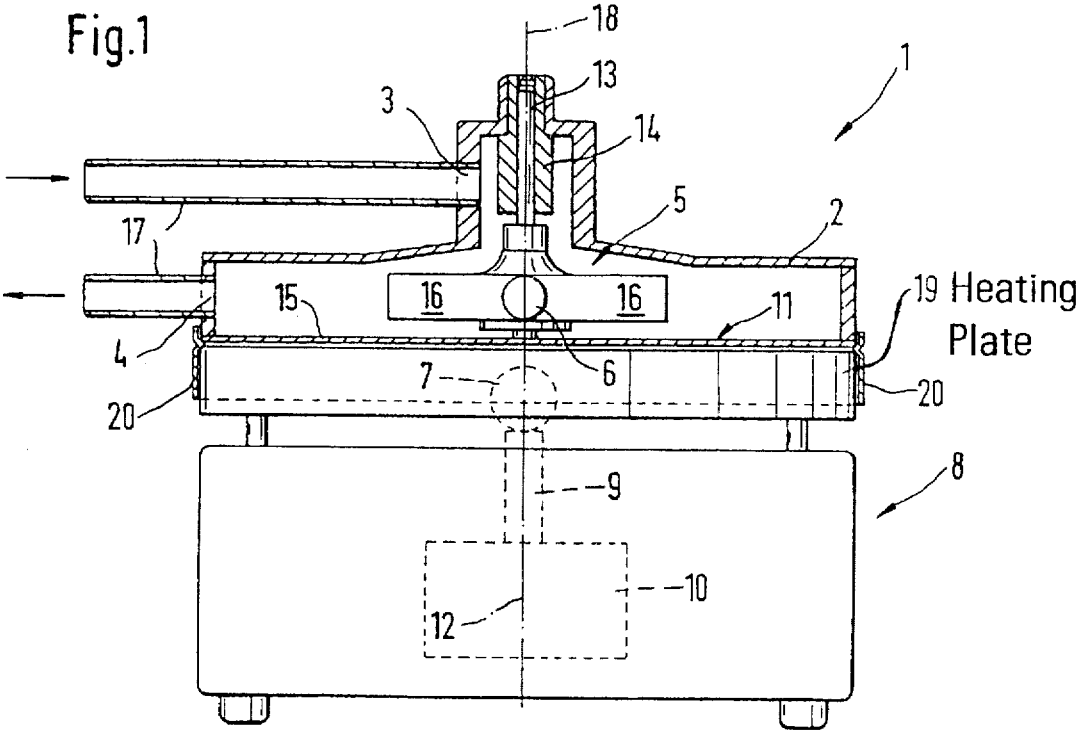
FIG. 1 shows a side view, partly in cross-section, of a laboratory pump placed with its coupling border on the heating plate of a magnetic stirrer.

A laboratory pump for liquids, designated in its entirety by 1, has a pump housing 2 with an inlet opening 3 and an outlet opening 4 and in which a pump rotor 5 rotates. The pump rotor 5 has a magnet 6 magnetically coupled with a drive magnet 7 of a magnetic stirrer 8. The drive magnet 7 is arranged on the free end of a drive shaft 9 of a drive motor 10 of the magnetic stirrer 8, and rotates adjacent to a placement surface 11 of the magnetic stirrer 8 and around the longitudinal axis 12 of the drive shaft 9, which is oriented perpendicular to the placement surface 11. In conjunction with that, the drive magnet 7 is centered on the drive shaft 9, and is aligned with its longitudinal axis perpendicular to the longitudinal axis 12 of the latter. As a result, the free ends of the drive magnet 7 which form the poles of the magnet rotate in a circular track that is parallel to the placement surface 11. The rotating magnetic field created as a result is coupled with the magnetic field of the magnet 6 that is likewise adjacent to and arranged with its longitudinal axis parallel to the placement surface 11, so that the magnet 6 and the pump rotor 5 joined with it rotate along with the drive magnet 7.

The laboratory pump 1 in accordance with the invention thus does not have any driving means of its own, but is instead driven by a magnetic stirrer 8. As a result of this, magnetic stirrers that are present in laboratories can also be used as laboratory pumps 1 by means of an easily mounted add-on part, and thus obtain an additional function. In this regard, the magnetic coupling between the pump rotor 5 and the magnetic stirrer 8 makes possible an especially simply constructed pump housing 2, in which a lead-through for a drive shaft of the pump rotor 5 can be eliminated.

On its top side, the pump rotor 5 is mounted in a rotating manner with a shaft 13 in a bearing bush 14 of the pump housing 2, and on its bottom side, it is supported on the lower housing wall 15. In conjunction with this, the longitudinal axes of the shaft 13 of the pump rotor 5 and the drive shaft 9 lie on a common axis when in the functional position.

The pump rotor 5 is configured as a vane pump impeller that centrally draws in the fluid to be delivered, and with the aid of the pumping blades or vanes 16 accelerates it radially towards the outside. The inlet opening 3 of the pump housing 2 is therefore arranged above the core region of the pump rotor 5, while the outlet opening 4 is provided circumferentially on the pump housing 2. Both the inlet opening 3 and the outlet opening 4 have connecting sleeves 17 on which, by way of example, a tube can be mounted or pushed on.

Figure 2:
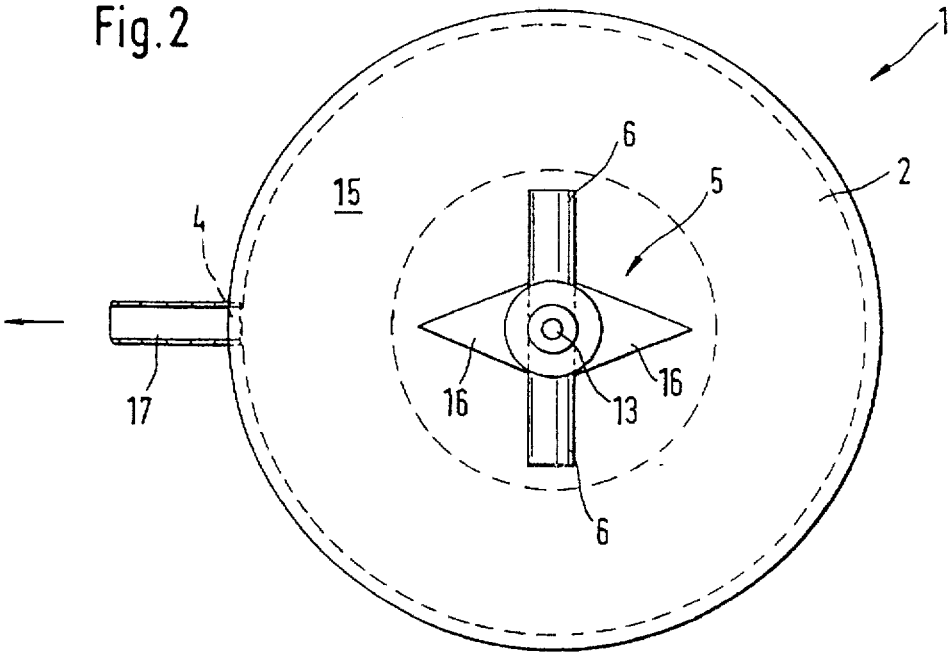

The pumping vanes 16 of the pump rotor 5 shown in FIGS. 1 and 2 are configured symmetrically and with their longitudinal center axis aligned radially to the rotation axis 18 of the pump rotor 5. As a result, the delivery power of the pump 1 is independent of the direction of rotation of the pump rotor 5, so that the latter can be used in the same manner with magnetic stirrers 8 that have a driving magnetic field with a right-hand or a left-hand direction of rotation. This is especially advantageous in the case of magnetic stirrers 8 with a reversible direction of rotation, since the pump 1 is effective regardless of the direction of rotation that has been set at that particular time.

The magnet 6 is arranged perpendicular to the two pumping vanes 16 on a diameter of the pump rotor 5, so that in practice, a total of four pumping vanes result, two of which are formed by the magnet 6 itself. In addition, because the magnet 6 is arranged in the rotation area of the pumping vanes 16, the space in the pump housing 2 reserved for the pump rotor 5 is reduced.

The magnetic stirrer 8 has a heating plate 19, which in its functional position contacts the lower housing wall 15 of the pump housing 2 and, as a result, is thermally well coupled with the latter. The heating plate 19 can therefore be used for warming the liquid that is being delivered by the pump 1, whereby the pump 1 in accordance with the invention is particularly well-suited for heating the bath liquid and thermostatically regulated, preferably double-walled containers. Thus, in an advantageous way it is not just the driving means of the magnetic stirrer 8 that can be used, but also its heating plate 19 for the circulation and temperature control of the bath liquid.

The pump housing 2 can be mounted on the heating plate 19 of the magnetic stirrer 8 by means of a coupling border 20 that runs around its circumference, as a result of which the pump housing 2, at least in the planar extent of the heating plate 19, is joined with the magnetic stirrer 8 in a positive-fit manner. As a result, the longitudinal axis 12 of the drive shaft 9 and the rotation axis 18 of the pump rotor 5 are centered with respect to each other when in the functioning position. In addition, the circumferential coupling border 20 also makes possible an especially good thermal coupling between the heating plate 19 and the pump housing 2, since the entire heat transfer surface of the heating plate 19 can be utilized. In order that the pump housing 2 can also be used together with magnetic stirrers 8 that have a heating plate 19 having an outside diameter greater than the inside diameter of the coupling border 20, the coupling border 20 can be separably attached to the pump housing 2.

Figure 3:
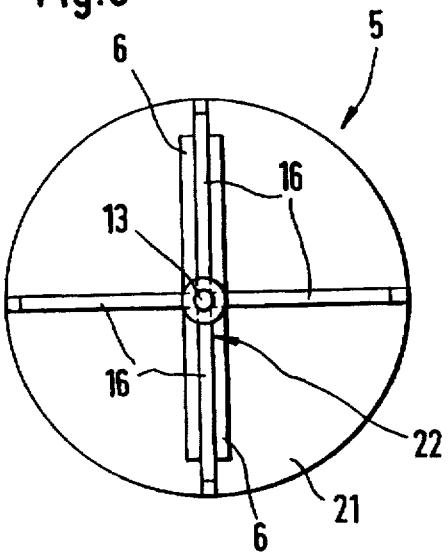
FIG. 3 shows a top view of a pump rotor with four pumping vanes directed radially to its rotation axis and arranged on a common carrier disk, which also holds the magnet.
Figure 4:
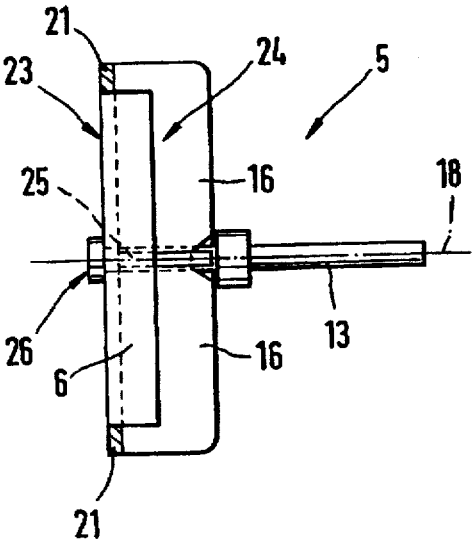
FIG. 4 shows a side view, partly in cross-section, of the pump rotor shown in FIG. 3.

FIGS. 3 and 4 show an embodiment of a pump rotor 5 with four pumping vanes 16 formed by thin lamina aligned radially to the rotation axis 18 of the pump rotor 5 and arranged on a common carrier disk 21. The carrier disk 21 is joined with the pumping vanes 16 as a single piece, and thus makes possible a solidly structured pump rotor 5 in spite of the thin-walled pumping vanes 16, which are beneficial for the flow.

The unit formed by the carrier disk 21 and the pumping vanes 16 is at the same time also designed as the holding means for the magnet 6. For this purpose, the carrier disk 21 has on its flat side (underside) a rectangular recess 22, which is arranged symmetrically to its rotation axis 18 and into which the magnet 6 is inserted with a longitudinal wall 23 flush with the underside of the carrier disk 21. The rectangular recess 22 is arranged centrally underneath two pumping vanes 16 that are displaced 180° from each other, in which a recess 24 for the magnet 6 is also provided. The magnet 6 thus engages into both the two pumping vanes 16 as well as into the carrier disk 21. In order to fix the magnet 6, the pumping vanes 16, and the carrier disk 21 into position, a retaining screw 25 is provided, which is inserted into the shaft 13. The screwhead of screw 25 forms the bearing surface 26 for the lower support bearing of the pump rotor 5.

Figure 5:
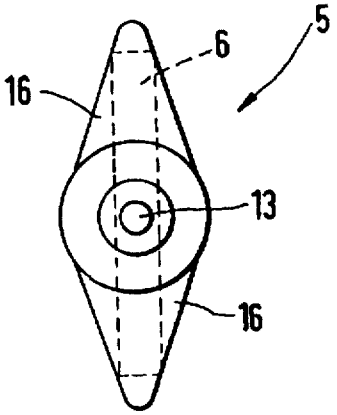
FIG. 5 shows a top view of a pump rotor with two pumping vanes arranged on a diameter and in which the magnet is embedded.
Figure 6:
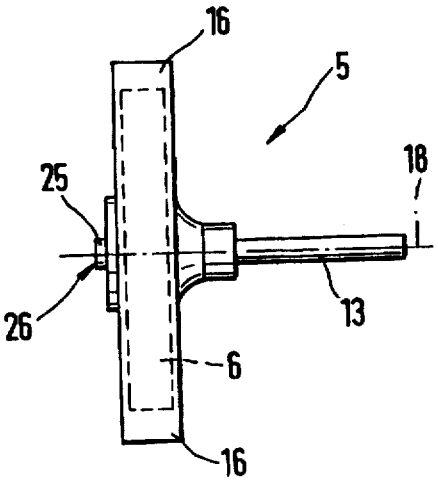
FIG. 6 shows a side view of the pump rotor shown in FIG. 5.

FIGS. 5 and 6 show a further embodiment of a pump rotor 5, which has arranged on one of its diameters on either side of its rotation axis 18 pumping vanes 16, which are made of plastic and in which the magnet 6 is embedded. As a result, there is provided an especially compactly designed pump rotor 5 in which the magnet 6 is especially well protected against corrosion.

The embodiment in accordance with FIGS. 3 and 4 makes possible an especially good magnetic coupling between the magnet 6 and the magnetic field of the magnetic stirrer 8, since the magnet 6 is arranged directly on the underside of the carrier disk 21, and thus as tightly as possible against the placement surface 11 of the magnetic stirrer 8.

Figure 7:
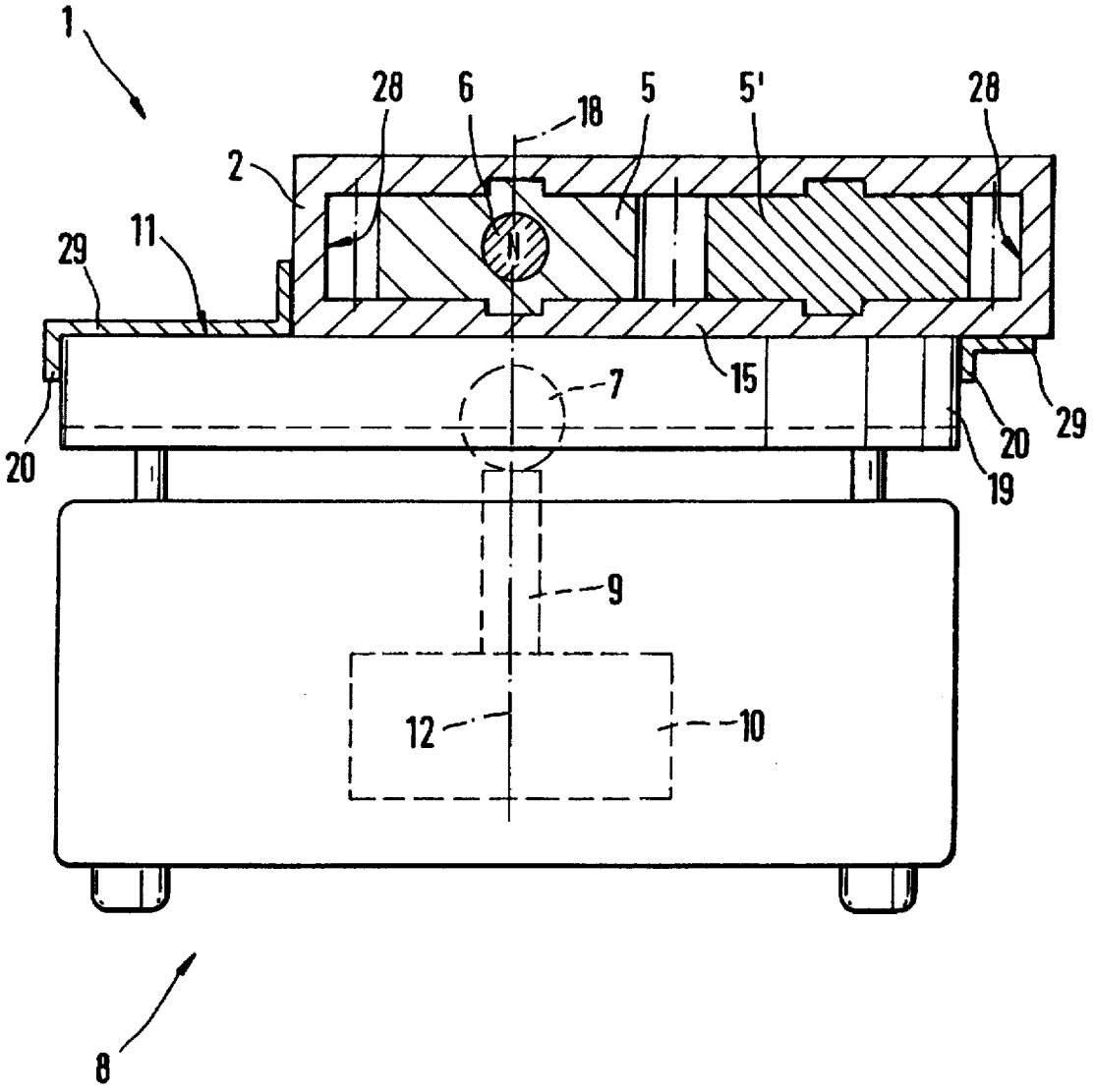
FIG. 7 shows a side view, partly in cross-section, of a gear pump, whose housing is placed with a coupling border on the heating plate of a magnetic stirrer.
Figure 8:
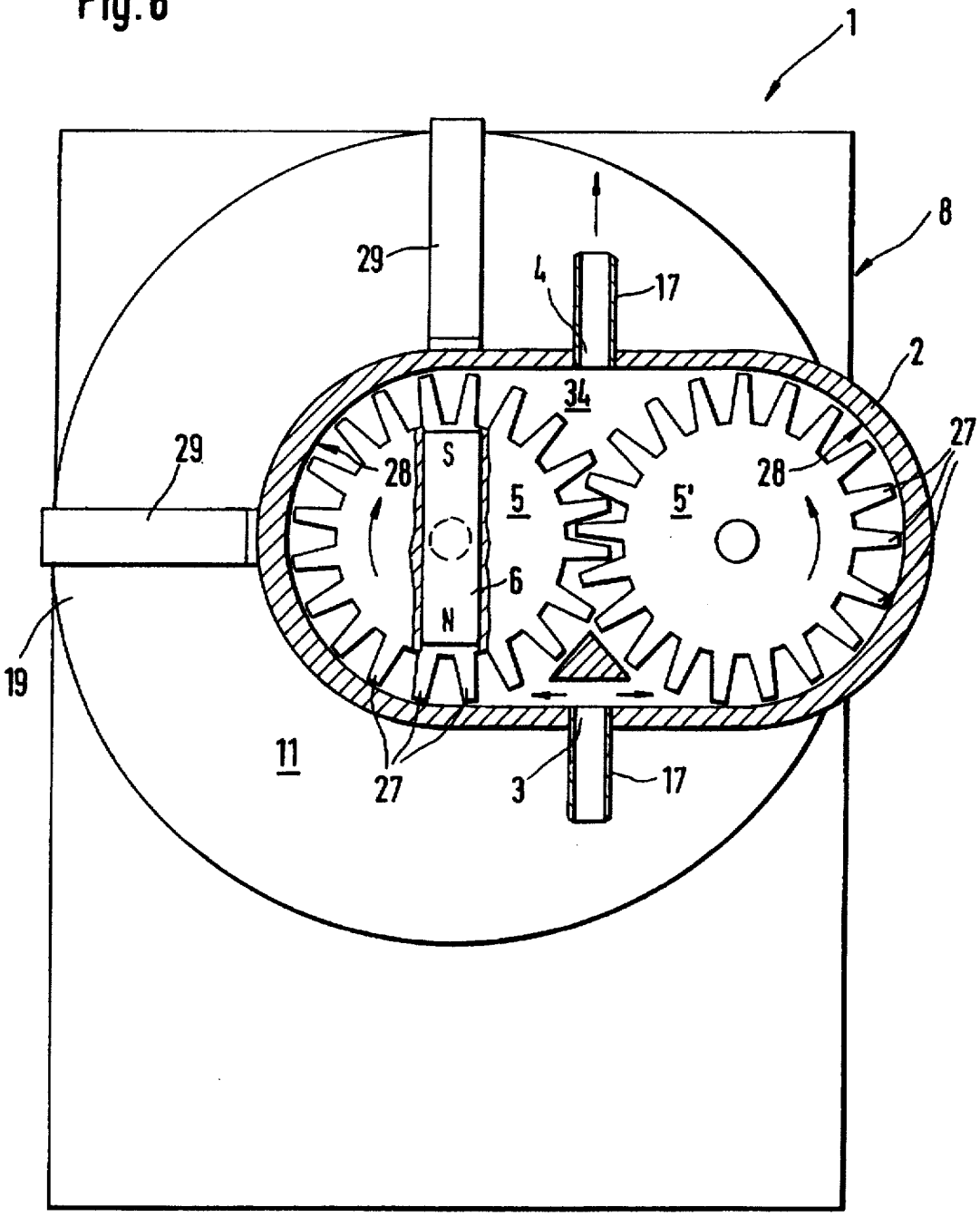
FIG. 8 shows a top view of the gear pump coupled with the magnetic stirrer, wherein the pump is shown partly in section.

The embodiment in accordance with FIGS. 7 and 8 shows a laboratory pump 1 having two pumping rotors 5, 5' that engage with each other and are configured as toothed spur gears. In conjunction with this, integrated centrally in the pump rotor 5 is a magnet 6, whose longitudinal axis arranged perpendicular to the rotation axis 18 of the pump rotor 5. With a gear pump of this type, which is well-known per se, the pumping medium that enters through the inlet opening 3 is engulfed by the conveying teeth 27, which are moving closely alongside of the inner pumping area side wall 28, and is displaced in the direction of the outlet opening 4. With a gear pump of this type, comparatively high delivery pressures can be attained. In the case of magnetic stirrers 8 in which the direction of rotation of the driving magnetic field can be reversed, the delivery direction of the pump 1 can in addition be reversed from forward to backward delivery. It is also beneficial that the connections for the inlet opening 3 and the outlet opening 4 are arranged laterally on the pump housing 2 so that the upper side of the pump housing 2 can be configured as a flat surface that can, for example, be used as a placement surface. In addition, the magnet 6 integrated into the pump rotor 5 makes possible an especially compact and flat pump housing 2.

Beyond that, the pump housing 2 has three holding arms 29, arranged radially to the rotation axis of the magnet 6 and displaced 90° from each other, each of which laterally engages the heating plate 19 in its operating position, so that the axis of the magnet 6 is arranged coaxial to the axis of the drive magnet 7 of the magnetic stirrer 8.

Figure 9:
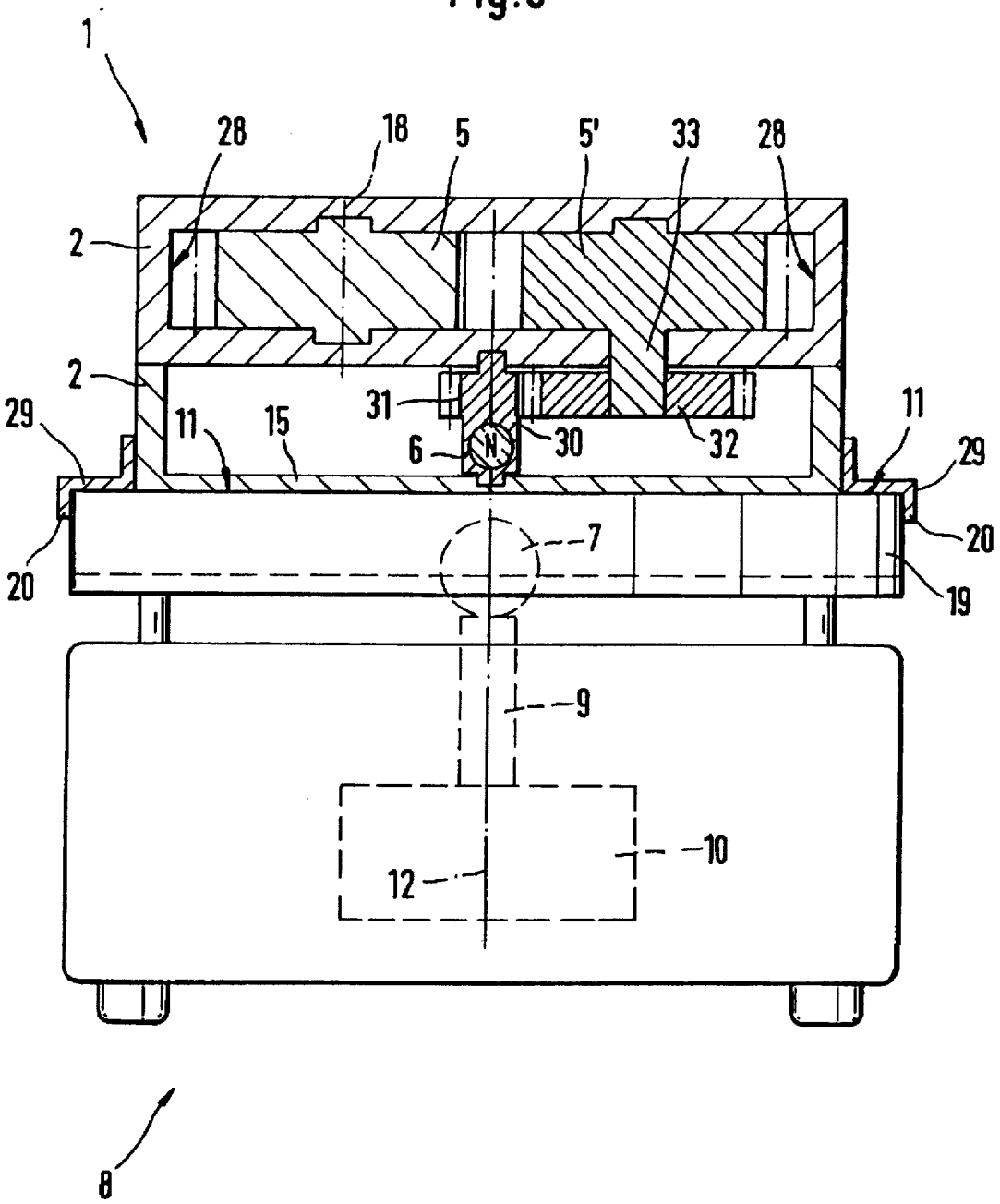
FIG. 9 shows a side view, partly in cross-section, of a gear pump magnetically coupled with a magnetic stirrer, in which the magnet is indirectly joined with the pump impellers by means of a transmission.
Figure 10:
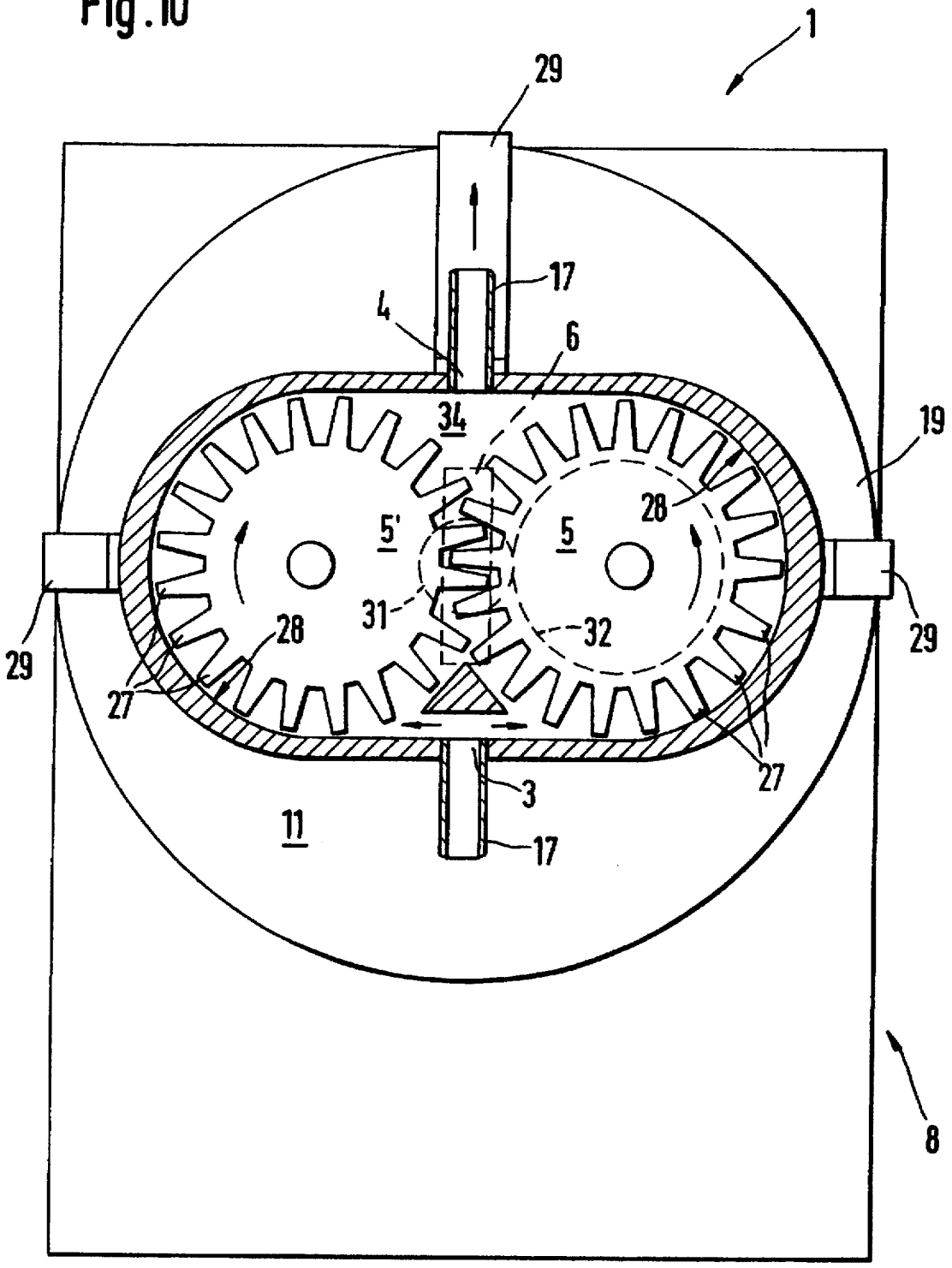
FIG. 10 shows a top view of the arrangement in accordance with FIG. 9, in which the gear pump is shown partly in cross-section.

In the embodiment in accordance with FIGS. 9 and 10, the magnet 6 is penetrated by a shaft 30 that carries a pinion gear 31, whose toothing is in engagement with the external toothing of an intermediate pinion gear 32, which is joined in a fixed rotating manner with the drive shaft 33 of the pump rotor 5'. In conjunction with this, the magnet is arranged centrally underneath the pinion gear 31 and with its longitudinal axis perpendicular to its rotation axis. The pinion gear 31 has a diameter that is clearly smaller than that of the intermediate pinion gear 32, so that overall, a gearing down results that reduces the rotation speed of the magnet 6 to a lower speed of the pump rotors 5, 5'. In order to permit as large a reduction ratio as possible, the magnet 6 in the embodiment in accordance with FIGS. 9 and 10 is arranged below the pinion gear 31, so that the diameter of the pinion gear 31 can be selected to be clearly smaller than the overall length of the magnet 6. As a result, in spite of a large reduction ratio and a comparatively small pinion gear, a relatively large magnet 6 can be provided that makes possible a good magnetic coupling to the driving magnetic field of the magnetic stirrer 8, or to its drive magnet 7.

The pinion gear 31 and the intermediate pinion gear 32 are arranged in an area of the pump housing 2 that is separate and sealed from the pumping area 34. The pump 1 is therefore especially well-suited for the delivery of viscous media, since the pumping medium does not come in contact either with the pinion gears 31, 32 or with the magnet 6, and thus can cause no friction on these parts.

It will be appreciated by those skilled in the art that changes could be made to the embodiments described above without departing from the broad inventive concept thereof. It is understood, therefore, that this invention is not limited to the particular embodiment disclosed, but it is intended to cover modifications within the spirit and scope of the present invention as defined by the appended claims.

I claim:

1. A laboratory pump (1) for liquids, comprising at least one pump housing (2) having an inlet opening (3) and an outlet opening (4), and at least one pump rotor (5) rotating inside the housing, the pump rotor (5) being connected with a magnet (6), and a magnetic stirrer (8) being provided as the driving means for the pump rotor (5), the magnetic stirrer (8) having a placement surface (11) and the pump (1) being connected to the magnetic stirrer by means of the pump housing (2) at least in the lateral direction of the placement surface (11), in such a way that a magnetic field of the magnetic stirrer (8) is in magnetic coupling with the magnet (6), and the magnetic stirrer (8) includes a heating plate (19), and a thermally conductive area is provided on a contact surface between the magnetic stirrer (8) and the pump housing (2).

2. The laboratory pump according to claim 1, wherein the pump rotor (5) is directly connected with the magnet (6).

3. The laboratory pump according to claim 1, wherein the pump rotor (5) is indirectly connected with the magnet (6) by a transmission.

4. The laboratory pump according to claim 1 wherein the pump rotor (5) is itself configured as a magnet.

5. The laboratory pump according to claim 1, wherein the pump rotor (5) is configured as a vane pump impeller.

6. The laboratory pump according to claim 1, wherein the pump rotor (5) comprises pumping vanes (16) that are configured symmetrically, whereby the pump rotor (5) can pump fluid when the pump (1) is driven in either direction of rotation.

7. The laboratory pump according to claim 1, wherein the pump (1) is heatable by means of heatable housing walls (15).

8. The laboratory pump according to claim 1, wherein the pump housing (2) further comprises attachment means for fixing it to the magnetic stirrer (8).

9. The laboratory pump according to claim 1, wherein the pump rotor (5) comprises at least two pumping vanes (16) arranged on opposite sides of its rotation axis (18) along one of its diameters, and the magnet (6) is arranged perpendicular to said diameter.

10. The laboratory pump according to claim 1, wherein the pump rotor (5) comprises at least two pumping vanes (16) arranged on opposite sides of its rotation axis (18) along one of its diameters, and the magnet is molded or inserted into said pumping vanes.

11. The laboratory pump according to claim 1, wherein the pump rotor (5) comprises a plurality of pumping vanes (16) arranged symmetrically to its rotation axis (18), and arranged on a common carrier disk (21).

12. The laboratory pump according to claim 1, wherein the magnet (6) is arranged closely adjacent to a housing wall (15) of the pump housing (2) that is adjacent to the placement surface (11) of the magnetic stirrer (8).

13. The laboratory pump according to claim 1, comprising two pump rotors (5, 5') that engage with one another, one of which is joined to the magnet (6) and which when in its operating position is coupled with a driving magnetic field of the magnetic stirrer (8).

14. The laboratory pump according to claim 13, wherein the two pump rotors (5, 5') comprise gearwheels of a gear pump.

15. The laboratory pump according to claim 14, wherein one gearwheel has additional toothing for engagement with a pinion gear (31) joined with the magnet (6).

16. The laboratory pump according to claim 1, wherein at least the magnet (6) is placed outside of a pumping area (34) of the pump.

17. A laboratory pump (1) for liquids, comprising at least one pump housing (2) having an inlet opening (3) and an outlet opening (4), and at least one pump rotor (5) rotating inside the housing, the pump rotor (5) being connected with a magnet (6), and a magnetic stirrer (8) being provided as the driving means for the pump rotor (5), the magnetic stirrer (8) having a heating plate (19) and a placement surface (11) and the pump (1) being connected to the magnetic stirrer by means of the pump housing (2) at least in the lateral direction of the placement surface (11), in such a way that a magnetic field of the magnetic stirrer (8) is in magnetic coupling with the magnet (6), and projections are provided on the pump housing (2) that encircle at least some regions of the placement surface, whereby the pump (1) can be mounted by the pump housing (2) in a positive-fit manner on the placement surface (11) of the magnetic stirrer (8) on the heating plate (19).

* * * * *